US007706736B2

(12) United States Patent
Watanabe

(10) Patent No.: US 7,706,736 B2
(45) Date of Patent: Apr. 27, 2010

(54) IMAGE FORMING SYSTEM, INCLUDING AN IMAGE FORMING APPARATUS AND POST-PROCESSING APPARATUS, THAT PERFORMS SHEET CONVEYANCE CONTROL AND POST-PROCESSING ON DISCHARGED SHEETS

(75) Inventor: Naoto Watanabe, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/183,256

(22) Filed: Jul. 31, 2008

(65) Prior Publication Data

US 2009/0041496 A1 Feb. 12, 2009

(30) Foreign Application Priority Data

Aug. 6, 2007 (JP) ..... 2007-204353

(51) Int. Cl.
*G03G 15/00* (2006.01)

(52) U.S. Cl. ..... 399/361; 399/16; 399/407; 270/58.07; 270/58.18

(58) Field of Classification Search ..... 399/16, 399/361, 407, 408; 270/58.07, 58.13, 58.15, 270/58.18, 58.19, 58.28
See application file for complete search history.

(56) References Cited

U.S. PATENT DOCUMENTS 7,245,871 B2 * 7/2007 Kasahara ..... 399/405
2003/0168796 A1 * 9/2003 Suzuki et al. ..... 270/58.07

FOREIGN PATENT DOCUMENTS

JP 2-147560 A 6/1990
JP 11-116134 A 4/1999

* cited by examiner

*Primary Examiner*—David M Gray
*Assistant Examiner*—Barnabas T Fekete
(74) *Attorney, Agent, or Firm*—Canon U.S.A., Inc. I.P. Division

(57) ABSTRACT

An image forming system includes an image forming apparatus and a post-processing apparatus that performs post-processing on sheets discharged from the image forming apparatus. The image forming system includes a feeding unit configured to store a plurality of sheets and successively feed the sheets; a stack unit configured to stack sheets processed by the post-processing apparatus; a state detection unit configured to detect a predetermined state of the stack unit; and a control unit configured to restrict the number of sheets fed from the feeding unit so that the number of sheets existing in a sheet conveyance path extending from the feeding unit to the stack unit does not exceed a predetermined number. The predetermined number is the number of sheets that the post-processing apparatus can receive from the image forming apparatus after detection of the predetermined state by the state detection unit.

13 Claims, 12 Drawing Sheets

IMAGE FORMING SYSTEM, INCLUDING AN IMAGE FORMING APPARATUS AND POST-PROCESSING APPARATUS, THAT PERFORMS SHEET CONVEYANCE CONTROL AND POST-PROCESSING ON DISCHARGED SHEETS

BACKGROUND OF THE INVENTION

1. Field of the Invention

The present invention relates to a sheet conveyance control performed in an image forming system, which includes an image forming apparatus (e.g., copying machine, laser beam printer, etc.) and a post-processing apparatus that performs post-processing on sheets discharged from the image forming apparatus.

2. Description of the Related Art

Print On Demand is a prospective technology and business process that can use advanced digital copying machines and relevant printing devices. To realize an image forming system suitable for the Print On Demand, a copying machine is arranged to be connectable with a plurality of large-capacity sheet feeding decks so that various types and different materials of sheets can be used and the sheet feeding operation can be continuously performed for a long time.

In general, an image forming apparatus is connected to a post-processing apparatus that performs insert processing for inserting cover/interleaf to a plurality of sheets output from an image forming apparatus. Furthermore, the image forming apparatus is connected to a plurality of post-processing apparatuses that perform staple processing, punching processing, bookbinding processing, stack processing, and other post-processing.

As discussed in Japanese Patent Application Laid-Open No. 2-147560, a conventional system detects a fully stacked condition of a discharge tray while sheets are discharged to the discharge tray. If the system detects a fully stacked condition of the discharge tray, the system switches the destination of discharged sheets to another discharge tray.

As discussed in Japanese Patent Application Laid-Open No. 11-116134, a conventional system continues stacking discharged sheets for a predetermined time after detection of a fully stacked condition of a discharge tray and then stops the operation performed by a post-processing apparatus.

However, if an image forming system includes a plurality of apparatuses, the length of a sheet conveyance path in the system is variable depending on the arrangement of respective apparatuses to be connected. Accordingly, as illustrated in FIGS. 11 and 12, the maximum number of sheets existing in a conveyance path extending from a sheet feeding unit of an image forming system to a sheet discharge portion of a post-processing apparatus during an image forming operation (hereinafter, referred to as "maximum number of sheets") is variable depending on the system arrangement.

However, according to the conventional system discussed in Japanese Patent Application Laid-Open No. 2-147560 or Japanese Patent Application Laid-Open No. 11-116134, the maximum number of sheets in the sheet conveyance path that may change depending on the system arrangement is not taken into consideration.

For example, according to a system arrangement illustrated in FIG. 11 including only a finisher and an image forming apparatus, all of sheets S (indicated by bold segments in FIG. 11) existing in a conveyance path can be discharged to a discharge tray even if the image forming apparatus stops image formation processing after detection of a fully stacked condition of the discharge tray. However, according to a system arrangement illustrated in FIG. 12 including a large-scale image forming system, all of sheets S existing in a conveyance path may not be completely discharged to a discharge tray after detection of a fully stacked condition of the discharge tray.

As described above, the number of sheets received by a finisher after detection of a fully stacked condition of a discharge tray is variable depending on the arrangement of respective apparatuses positioned at the upstream side of the finisher.

Therefore, a post-processing apparatus connected to a large-scale image forming system illustrated in FIG. 12 is required to surely receive all the sheets existing in a conveyance path after a fully stacked condition of a discharge tray is detected.

However, if the maximized arrangement of a system is taken into consideration, a small value is set as the number of sheets that identifies a fully stacked condition of the discharge tray. In this case, the determined number of stackable sheets is too small for another arrangement of the system which is not the maximized arrangement.

Furthermore, if the number of sheets that a post-processing apparatus can receive after detection of a fully stacked condition is set to a value comparable to the maximum number of sheets that can remain in a conveyance path, the scale and the cost of the system increase. Furthermore, when the current maximized arrangement is taken into consideration, the arrangement of a discharge tray applicable to the present system will be no longer effective for scale expansion of the system in the future.

Moreover, if the arrangement of an apparatus is determined considering the maximized system, it becomes an over-designed system and does not suit for a minimized system including only an image forming apparatus and a post-processing apparatus.

SUMMARY OF THE INVENTION

It is desirable to provide an image forming system that enables a post-processing apparatus to surely receive all the sheets existing in a conveyance path, without increasing the cost.

According to an aspect of the present invention, an image forming system is provided including an image forming apparatus and a post-processing apparatus that performs post-processing on sheets discharged from the image forming apparatus. In particular, the image forming system includes a feeding unit configured to store a plurality of sheets and successively feed the sheets; an image forming unit configured to form an image on a sheet according to a setting content of an image formation job; a stack unit configured to stack sheets processed by the post-processing apparatus; a state detection unit configured to detect a predetermined state of the stack unit, the predetermined state being a state in which the stack unit cannot receive any sheet; and a control unit configured to determine, based on the setting content of an image formation job, a number of sheets that the post-processing apparatus can receive from the image forming apparatus after detection of the predetermined state. The control unit is operable to restrict a number of sheets fed from the feeding unit so that a number of sheets existing in a sheet conveyance path extending from the feeding unit to the stack unit does not exceed the determined number of sheets.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments and features of the invention and, together with the description, serve to explain at least some of the principles of the invention.

DETAILED DESCRIPTION OF THE EMBODIMENTS

Figure 1:
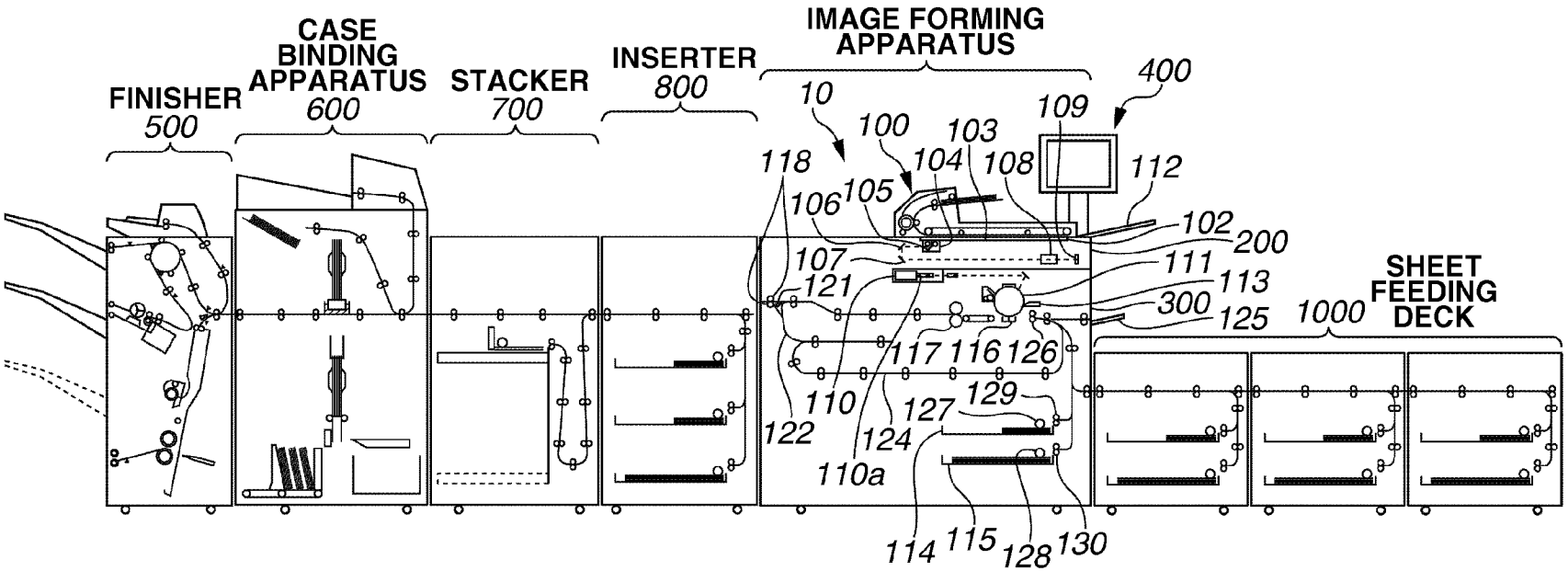
FIG. 1 illustrates an example image forming system.

The following description of exemplary embodiments is illustrative in nature and is in no way intended to limit the invention, its application, or uses. It is noted that throughout the specification, similar reference numerals and letters refer to similar items in the following figures, and thus once an item is described in one figure, it may not be discussed for following figures. Exemplary embodiments will be described in detail below with reference to the drawings.

FIG. 1 illustrates an example image forming system according to an exemplary embodiment of the present invention.

The image forming system includes an image forming apparatus 10, a plurality of post-processing apparatuses, and a sheet feeding deck 1000. The post-processing apparatuses according to an exemplary embodiment are a finisher 500, a case binding apparatus 600, a stacker 700, and an inserter 800. The image forming apparatus 10 includes an image reader 200 and a printer 300. The image reader 200 is configured to read an image of an original.

The image reader 200 is associated with a document feeder 100 mounted thereon. The document feeder 100 successively sends originals (e.g., document papers) set on a document tray. The document feeder 100 conveys stacked originals one after another from the top thereof along a curved path to the left side on the drawing surface of FIG. 1. The document feeder 100 guides a conveyed original from left to right via a reading position on a platen glass 102. Then, the document feeder 100 discharges the original to an external discharge tray 112.

The image reader 200 includes a scanner unit 104 located at a predetermined position to read an image of an original that passes the reading position on the platen glass 102. The above-described reading method can be referred to as "skimming through the original" method. More specifically, when an original passes a skim-reading position on the platen glass 102, a lamp 103 of the scanner unit 104 illuminates an image surface of the original to be read. Reflection light from the original reaches a lens 108 via mirrors 105, 106, and 107. Light, after passing through the lens 108, forms an image on an image formation surface of an image sensor 109.

As described above, when the document feeder 100 conveys an original from left to right across the skim-reading position, the scanner unit 104 performs scanning for reading the original along a main-scanning direction corresponding to a direction perpendicular to a conveying direction of the original and a sub-scanning direction corresponding to the conveying direction.

More specifically, when the original passes the skim-reading position, the image sensor 109 reads an image of each line on the original in the main-scanning direction. The document feeder 100 conveys the original in the sub-scanning direction so that the image sensor 109 can read images of other lines on the original.

The image sensor 109 converts an optically read image into image data, and a later-described image signal control unit 922 performs predetermined processing on the image data. Then, the image data is output as a video signal to an exposure control unit 110 of the printer 300.

Alternatively, the document feeder 100 can convey and stop an original at a predetermined position on the platen glass 102. In this state, the scanner unit 104 can perform scanning from left to right to read the original. This reading method can be referred to as "original fixed-reading" method.

As a method for reading the original without using the document feeder 100, a user can raise the document feeder 100 upward and manually place the original on the platen glass 102 and then cause the scanner unit 104 to perform scanning from left to right to read the original. In other words, a user can select the "original fixed-reading" operation to read the original without using the document feeder 100.

The printer 300 includes an exposure control unit 110 that modulates a laser beam based on an input video signal and outputs a modulated laser beam toward a polygon mirror 110*a*. When the polygon mirror 110*a* rotates, a photosensitive drum 111 is irradiated with a modulated laser beam. An electrostatic latent image can be formed on the photosensitive drum 111 according to a scanning of the laser beam. In the "original fixed-reading" operation, the exposure control unit 110 controls a laser beam to form an image in the direction identical to that of the original (not a mirror image), as described later.

When a developing unit 113 supplies developer to the photosensitive drum 111, an electrostatic latent image (referred to as "developer image") can be visualized on the photosensitive drum 111. The image forming apparatus 10 includes an upper cassette 114, a lower cassette 115, and a manual sheet feeding unit 125 from which recording sheets can be supplied to the printer 300 in synchronism with irradiation of a laser beam.

The sheet feeding deck 1000 has a plurality of decks from which recording sheets can be supplied to the printer 300. When the printer 300 performs a two-sided printing, recording sheets are supplied to the printer 300 via a two-sided printing conveyance path 124. In any case, a recording sheet is conveyed to a clearance between the photosensitive drum 111 and a transfer unit 116. The transfer unit 116 transfers a developer image from the photosensitive drum 111 onto a supplied recording sheet.

A fixing unit 117 receives a recording sheet that carries a transferred developer image. The fixing unit 117 applies heat and pressure on the recording sheet to fix the developer image. A recording sheet, having passed through the fixing unit 117, successively passes a flapper 121 and a pair of discharge rollers 118 and exits out of the printer 300 toward an external post-processing apparatus.

If discharging a face-down recording sheet (i.e., a state where an image formation surface of the sheet faces downward) is desired, the flapper 121 performs a switching operation to once guide the recording sheet having passed through the fixing unit 117 to a reversing path 122. Then, if a rear edge of the recording sheet has passed through the flapper 121, the discharge rollers 118 cause the recording sheet to make a switchback motion and discharge the recording sheet out of the printer 300. The above-described discharging operation can be referred to as "inversed discharge" operation. The image forming apparatus 10 can perform the inversed discharge operation to record images of a document set on the document feeder 100 or document data supplied from a computer, so that discharged recording sheets can be regularly ordered from its head page.

Furthermore, a manual feeding unit 125 enables a user to supply sheets that are harder than plain papers such as OHP sheets. In this case, after an image is formed on a recording sheet supplied from the manual feeding unit 125, the discharge rollers 118 can discharge a face-up recording sheet (i.e., a state where an image formation surface of a sheet faces upward) without guiding the recording sheet to the reversing path 122.

Furthermore, if the image forming apparatus 10 operates in a two-sided recording mode to form images on both surfaces of a recording sheet, the flapper 121 performs a switching operation to once guide the recording sheet to the reversing path 122 and then convey the recording sheet to a two-sided conveying path 124. Then, at the above-described timing, the recording sheet is conveyed from the two-sided conveying path 124 to the clearance between the photosensitive drum 111 and the transfer unit 116.

The inserter 800 receives sheets discharged from the printer 300. The inserter 800 performs insert processing on received sheets according to post-processing content designated in a print job. The sheets processed by the inserter 800 are successively discharged to the stacker 700, the case binding apparatus 600, and the finisher 500.

If a print job does not include any setting of insert processing, sheets discharged from the image forming apparatus 10 are conveyed to a downstream apparatus (the stacker 700) via a common conveyance path provided in the inserter 800. If a print job designates a sheet discharge destination other than the stacker 700, sheets are conveyed to a downstream apparatus (the case binding apparatus 600) via a common conveyance path provided in the stacker 700. If a print job designates the finisher 500 as a sheet discharge destination, the sheets having passed though the stacker 700 are conveyed to the finisher 500 via a common conveyance path provided in the case binding apparatus 600.

Figure 2:
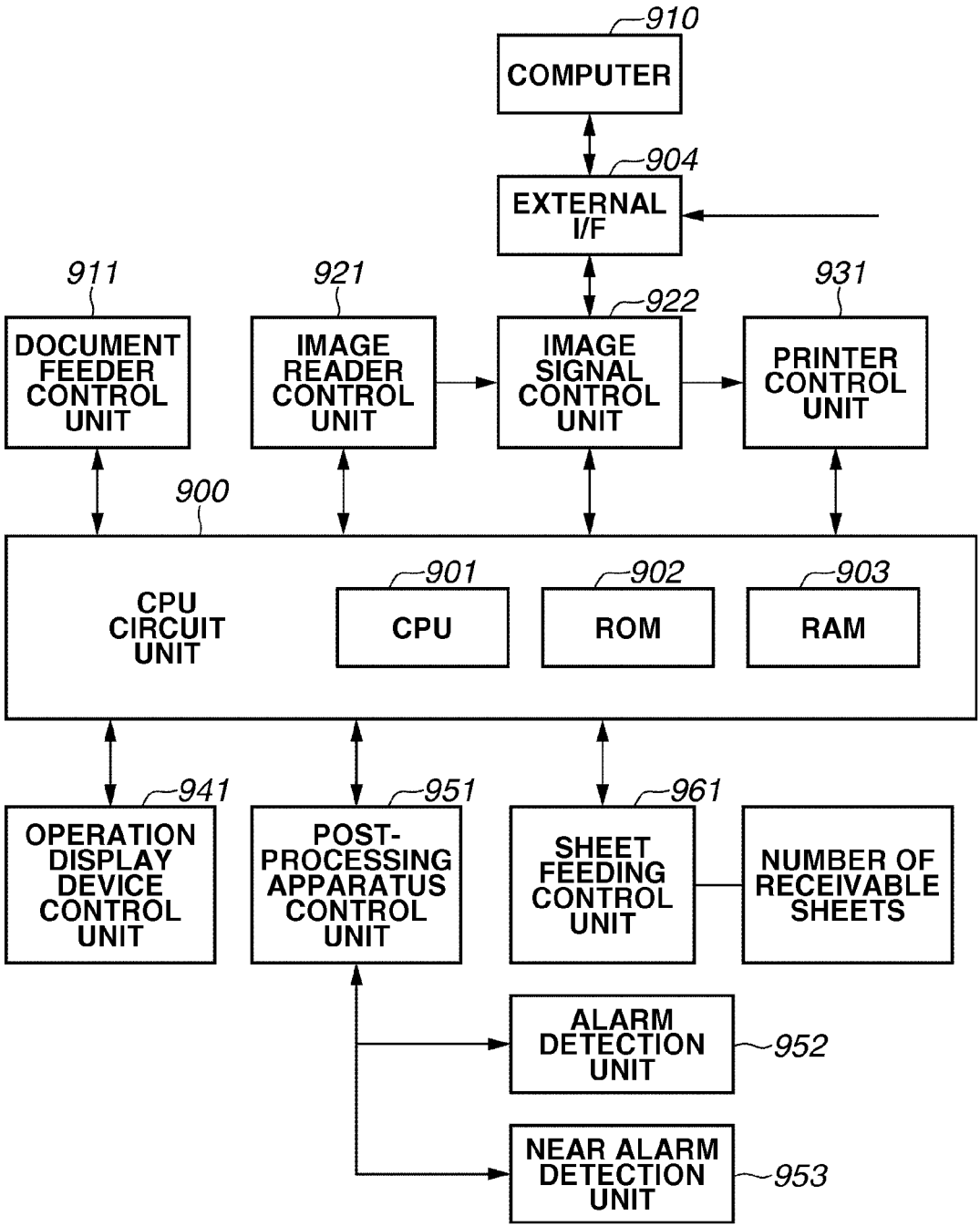
FIG. 2 is a block diagram illustrating an example image forming system.

FIG. 2 is a block diagram illustrating a controller that controls the image forming system illustrated in FIG. 1. The controller is incorporated in the image forming apparatus 10 illustrated in FIG. 1.

The controller includes a central processing unit (CPU) circuit unit 900. The CPU circuit unit 900 includes a central processing unit (CPU) 901, a read only memory (ROM) 902, and a random access memory (RAM) 903. The CPU circuit unit 900 controls various blocks 911, 921, 922, 931, 941, 951, and 961 based on control programs stored in the ROM 902. The RAM 903 temporarily stores control data and functions as a work area for the CPU 901 that executes various control processing. The CPU circuit unit 900 communicates with each apparatus in the image forming system and can detect an operating state of the apparatuses.

The document feeder control unit 911 performs control for driving the document feeder 100 based on an instruction supplied from the CPU circuit unit 900. The image reader control unit 921 controls the scanner unit 104 and the image sensor 109. The image reader control unit 921 receives an analog image signal from the image sensor 109 and transfers the received signal to the image signal control unit 922.

The image signal control unit 922 converts an analog image signal received from the image sensor 109 into a digital signal. The image signal control unit 922 performs various processing on the converted digital signal. Then, the image signal control unit 922 converts the digital signal into a video signal and outputs the video signal to the printer control unit 931. The image signal control unit 922 receives a digital image signal from a computer 910 via an external interface (I/F) 904, and performs various processing on the input signal. The image signal control unit 922 converts the digital image signal into a video signal and outputs the video signal to the printer control unit 931. The image signal control unit 922 performs processing under the control of the CPU circuit unit 900.

The printer control unit 931 drives the above-described exposure control unit 110 based on an input video signal.

The operation display device control unit 941 transmits information from the CPU circuit unit 900 to an operation display device 400 or vice versa. The operation display device 400 includes a plurality of keys operated to set various image forming functions and a display unit configured to display information indicating a state of settings. The operation display device control unit 941 outputs a key signal corresponding to each key operation to the CPU circuit unit 900. The operation display device 400 receives a signal supplied from the CPU circuit unit 900 and displays corresponding information on the display unit.

The post-processing apparatus control unit 951 controls post-processing apparatuses, including finisher 500, case binding apparatus 600, stacker 700, and inserter 800. The post-processing apparatus control unit 951 receives various information, including discharge completion information (information relating to a sheet or a sheet stack discharged to a discharge portion), from each post-processing apparatus.

The post-processing apparatus control unit 951 is associated with an alarm detection unit 952 and a near alarm detection unit 953. The post-processing apparatus control unit 951 manages the alarm detection unit 952 to detect an alarm state occurring in each post-processing apparatus and manages the near alarm detection unit 953 to detect a near alarm state occurring in each post-processing apparatus.

If an "alarm" state occurs in a post-processing apparatus, the post-processing apparatus cannot receive any sheet. As described later, the finisher 500 is in an alarm state when the sheet discharge tray is fully stacked. The case binding apparatus 600 is in an alarm state when a scrap box is opened. The "near alarm" state precedes the "alarm" state.

The sheet feeding control unit 961 controls a sheet feeding operation performed by each sheet feeding unit of the cassettes 114 and 115, the manual feeding unit 125, and the sheet feeding deck 1000 in response to an instruction from the CPU circuit unit 900. The sheet feeding control unit 961 has a function of limiting the number of sheets to be conveyed (performs a sheet conveyance limiting operation).

More specifically, the sheet feeding control unit 961 controls the sheet feeding operation based on the number of sheets fed from the sheet feeding unit and discharge completion information obtained from the post-processing apparatus control unit 951, so that the number of sheets existing in a conveyance path between the sheet feeding unit and the discharge portion of a post-processing apparatus (sheet discharge destination) is equal to or less than the number of receivable sheets. In an exemplary embodiment, the number of receivable sheets is the number of sheets that a post-processing apparatus can receive after an alarm state occurs.

The CPU circuit unit 900 executes receivable sheet amount determination processing for determining the number of receivable sheets based on post-processing apparatus related conditions and sheet conveyance operation conditions. Furthermore, the CPU circuit unit 900 executes processing for determining whether a sheet discharge destination (an apparatus designated as a destination to which a sheet is discharged) is an apparatus that can postpone execution timing of a later-described sheet conveyance control until a near alarm state is detected.

The CPU circuit unit 900 communicates with a post-processing apparatus that is in an operative state when the image forming system starts its operation, and determines whether each post-processing apparatus can delay the execution timing. The CPU circuit unit 900 stores acquired information in the RAM 903.

Figure 3:
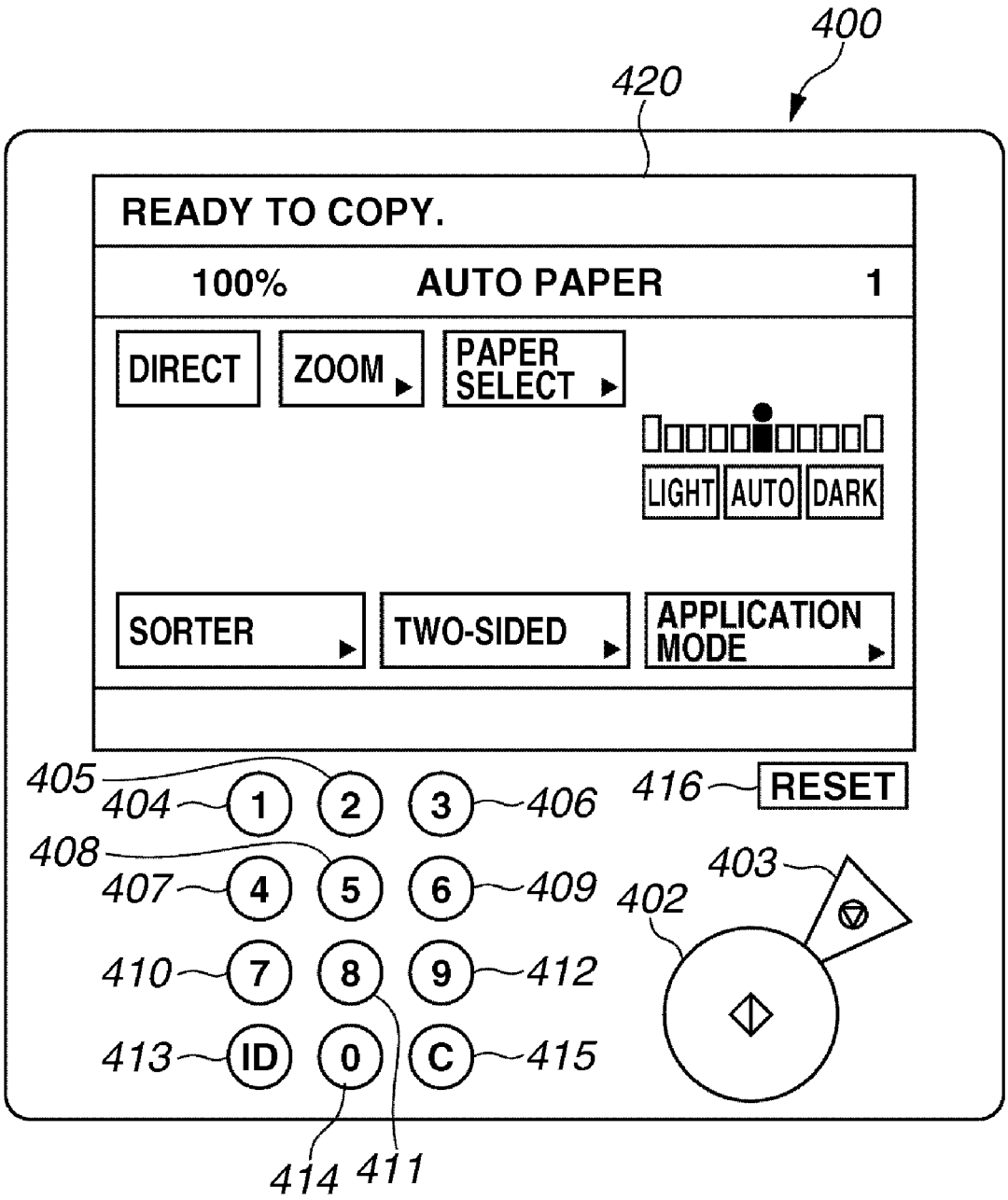
FIG. 3 illustrates an example operation display device.

FIG. 3 illustrates the operation display device 400 of the image forming apparatus 10 illustrated in FIG. 1.

The operation display device 400 includes a start key 402 that enables a user to instruct the image forming apparatus 10 to start an image forming operation, a stop key 403 that enables a user to instruct the image forming apparatus 10 to interrupt the image forming operation, and ten keys 404 to 412 and 414 that enable a user to perform numerical register settings.

Furthermore, the operation display device 400 includes an identification (ID) key 413, a clear key 415, a reset key 416, and a user mode key 417 that enable a user to perform various apparatus settings. The operation display unit 400 includes a liquid crystal display unit 420 (e.g., a touch panel) The liquid crystal display unit 420 can provide soft keys on its screen.

The image forming apparatus 10 has various post-processing modes, such as non-sort, sort, staple sort (binding mode), and bookbinding modes. The operation display device 400 enables a user to set a desired processing mode.

Figure 4:
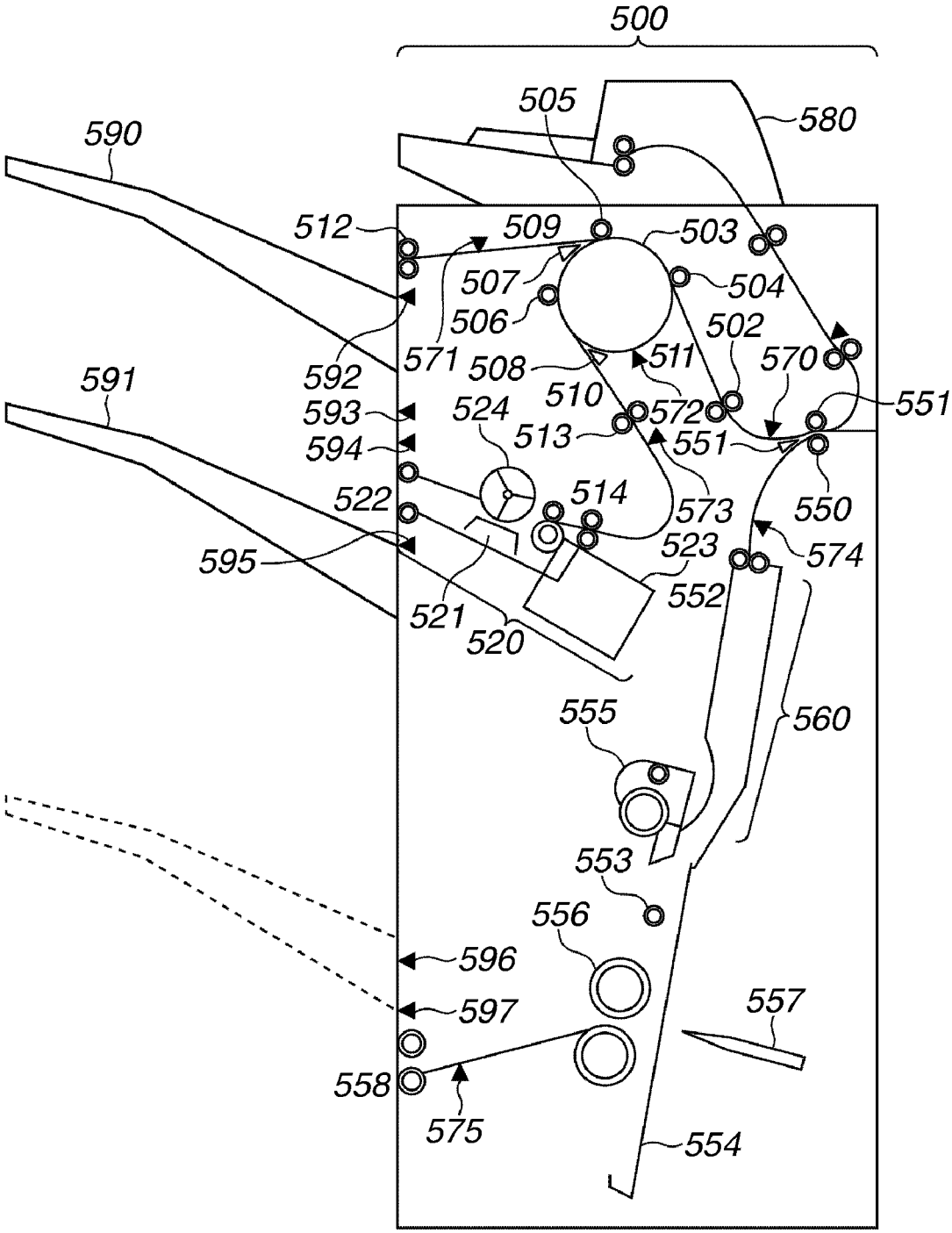
FIG. 4 illustrates a cross-sectional view of a finisher.
Figure 7:
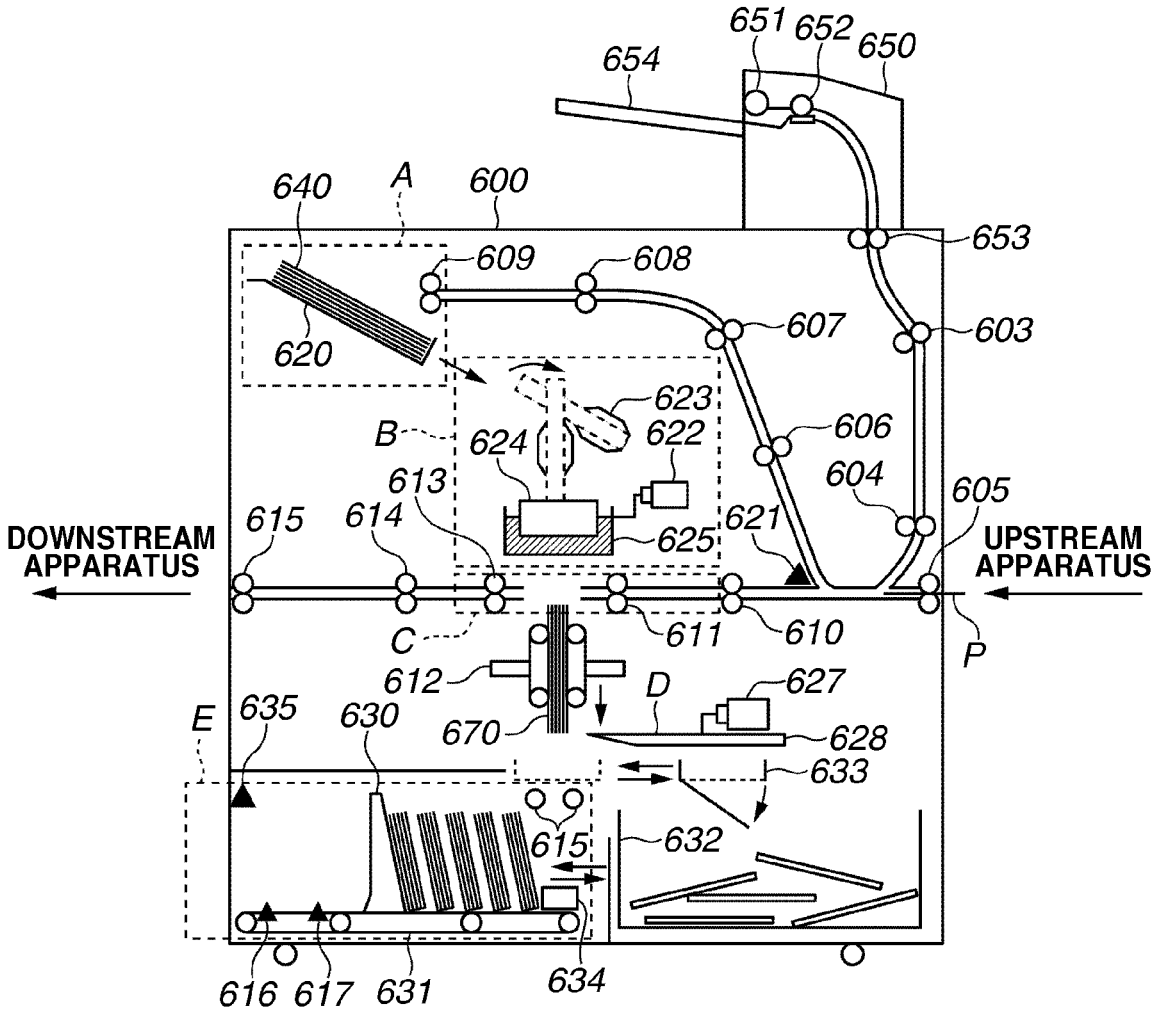
FIG. 7 illustrates a cross-sectional view of an example case binding apparatus.

An example sheet conveyance control according to an exemplary embodiment of the present invention is described below. FIG. 4 is a cross-sectional view of the finisher 500. FIG. 7 is a cross-sectional view of the case binding apparatus 600.

The finisher 500 successively receives sheets discharged from an upstream side apparatus (e.g., image forming apparatus 10) and performs various post-processing on the received sheets. For example, the post-processing includes alignment processing for aligning a bundle of sheets by jogging front edges of received sheets, staple processing for binding the read end of the bundle of sheets, punching processing for punching at predetermined positions near the rear end of the sheets, sort processing, non-sort processing, and bookbinding processing.

The finisher 500 includes a pair of inlet rollers 501 that receive a sheet conveyed from an upstream side apparatus and a pair of conveyance rollers 502 that convey a sheet toward a buffer roller 503. An inlet sensor 570 is provided in a conveyance path between the inlet roller pair 501 and the conveyance roller pair 502. A switching flapper 551 is located at the downstream side of the inlet roller pair 501.

The switching flapper 551 can switch the sheet conveyance destination among a sort path 510, a non-sort path 509, and a bookbinding path 550. The buffer roller 503 has an outer cylindrical surface around which a predetermined number of sheets can be held when conveyed via the conveyance roller pair 502. A plurality of pressing rollers 504, 505, and 506, provided around the buffer roller 503, press a sheet when the sheet is conveyed by the buffer roller 503 rotating in a predetermined direction.

A switching flapper 507, located between the pressing rollers 505 and 506, switches the conveyance destination of a sheet conveyed by the buffer roller 503 between the non-sort path 509 and the sort path 510. A switching flapper 508, located at the downstream side of the pressing roller 506, removes a sheet from the buffer roller 503 and guides the sheet to the sort path 510. The switching flapper 508 can also guide a sheet to a buffer path 511 while the sheet is held around the buffer roller 503.

To guide a sheet held around the buffer roller 503 to the non-sort path 509, the switching flapper 507 operates to remove the sheet from the buffer roller 503. A pair of discharge rollers 512, provided at the downstream end of the non-sort path 509, discharges a conveyed sheet to a sample tray 590 that serves as a stack unit. A sheet discharge sensor 571, provided at an appropriate position of the non-sort path 509, detects a sheet discharged out of the finisher 500.

A sheet surface detection sensor 592, a near-full stack detection sensor 593, and a full stack detection sensor 594, dedicated to the sample tray 590, can detect the amount of sheets stacked on the sample tray 590. The finisher 500 controls the position of the sample tray 590 so that the sheet surface detection sensor 592 can detect the upper surface position of sheets stacked on the sample tray 590. When the full stack detection sensor 594 detects the lower surface position of the sample tray 590 in a state where the sheet surface detection sensor 592 detects the upper surface position of stacked sheets, it is determined that the amount of sheets stacked on the sample tray 590 is in a fully stacked condition.

The fully stacked condition corresponds to a state where the remaining amount of sheets stackable on the sample tray 590 is equal to a first predetermined amount. The fully stacked condition corresponds to an abnormal state according to the present invention. The full stack detection sensor 594 is configured to operate as a state detection unit. When the full stack detection sensor 594 detects a fully stacked state, the finisher 500 is in the above-described alarm state. When the finisher 500 is in the alarm state, the system controls the sheet feeding unit not to newly feed any sheet. The alarm state is referred to as "full stack alarm."

If the near-full stack detection sensor 593 detects the lower surface position of the sample tray 590 in a state where the sheet surface detection sensor 592 detects the upper surface position of stacked sheets, it is determined that the amount of sheets stacked on the sample tray 590 is near the fully stacked condition. The state near the fully stacked condition is a state where the remaining amount of sheets stackable on the sample tray 590 is equal to a second predetermined amount (>first predetermined amount).

The state of the finisher 500 preceding the abnormal state corresponds to the alarm state. The near-full stack detection sensor 593 operates as an alarm state detection unit. When the near-full stack detection sensor 593 detects a state near the fully stacked condition, the finisher 500 is in a near alarm state preceding the alarm state. The near alarm state is referred to as a "full stack near alarm."

When the finisher 500 conveys a sheet from the buffer roller 503 to the buffer path 511, the sheet is continuously held on the cylindrical surface of the buffer roller 503 while both the switching flapper 507 and the switching flapper 508 are kept in an inoperative state. A buffer path sensor 572, provided at an appropriate position of the buffer path 511, detects a sheet moving along the buffer path 511.

When the finisher 500 conveys a sheet from the buffer roller 503 to the sort path 510, the switching flapper 508 operates to remove the sheet from the buffer roller 503 while the switching flapper 508 is kept in an inoperative state. A sort path sensor 573, provided at an appropriate position of the sort path 510, detects a sheet moving along the buffer path 511. Conveyance roller pairs 513 and 514 guide a sheet conveyed along the sort path 510 to a processing tray 520.

A sheet stack on the processing tray 520 is subjected to alignment processing by an alignment member 521 and staple processing by a stapler 523, if necessary. Discharge rollers 522*a* and 522*b* are provided at the downstream side of the alignment member 521 and the stapler 523 to discharge a sheet to the stack tray 591 that operates as a stack unit. In FIG. 4, a dotted line indicates a state where the stack tray 591 is lowered. The finisher 500 according to an exemplary embodiment has a pair of alignment members 521 provided at a near side and a far side of the processing tray 520, when seen from the front of the finisher 500 (on the drawing surface of FIG. 4).

A swing guide 524 supports the discharge roller 522*b*. When a swing motor (not illustrated) drives the swing guide 524, the discharge roller 522*b* abuts the uppermost sheet on the processing tray 520. In a state where the discharge roller 522*b* abuts the uppermost sheet on the processing tray 520, the discharge rollers 522*a* and 522*b* can cooperatively discharge a bundle of sheets from the processing tray 520 to the stack tray 591.

A sheet surface detection sensor 595, a near-full stack detection sensor 596, and a full stack detection sensor 597 can detect the amount of sheets on the stack tray 591. The finisher 500 controls the position of the stack tray 591 so that the upper surface position of a bundle of sheets on the stack tray 591 can be detected by the sheet surface detection sensor 595.

When the full stack detection sensor 597 detects the lower surface position of the stack tray 591 in a state where the sheet surface detection sensor 595 detects the upper surface position of the stacked sheets, it is determined that the amount of sheets stacked on the stack tray 591 is in a fully stacked condition (alarm state).

When the near-full stack detection sensor 596 detects the lower surface position of the stack tray 591 in a state where the sheet surface detection sensor 595 detects the upper surface position of stacked sheets, it is determined that the amount of sheets stacked on the stack tray 591 is near the fully stacked condition. The state where the amount of sheets stacked on the stack tray 591 is near the fully stacked condition is regarded as the near alarm state.

The image forming apparatus 10 performs processing for changing the sheet conveyance control and stopping the image forming operation, if the image forming apparatus 10 receives a full stack alarm or a full stack near alarm, which indicates an alarm state of the sheet stack unit (the sample tray 590 and the stack tray 591), from the post-processing apparatus control unit 951.

The stapler 523 performs staple processing. The stapler 523 can move along the outer periphery of the processing tray 520 and is configured to bind a bundle of sheets stacked on the processing tray 520 at the rear end in a sheet conveyance direction. A sheet conveyed along the bookbinding path 550 is conveyed to a bookbinding intermediate tray (hereinafter, referred to as "bookbinding processing tray") 560 via a conveyance roller pair 552. A bookbinding inlet sensor 574 is provided at an appropriate position of the bookbinding path 550.

The bookbinding processing tray 560 is associated with an intermediate roller 553 and a movable sheet positioning member 554. A stapler 555 and an anvil (not illustrated) are provided in an opposed relationship. The stapler 555 and the anvil cooperatively perform staple processing on a bundle of sheets stored in the bookbinding processing tray 560. A folding roller pair 556 and a pushing member 557, provided at the downstream side of the stapler 555, are in an opposed relationship.

When the pushing member 557 protrudes toward a bundle of sheets held by the bookbinding processing tray 560, the bundle of sheets is bent and inserted between the folding roller pair 556. The folding roller pair 556 folds the bundle of sheets and conveys the folded bundle of sheets to a downstream apparatus via a conveyance roller pair 558. A sheet discharge sensor 575, provided at the downstream side of the conveyance roller pair 558, detects a bundle of sheets discharged.

FIG. 7 is a cross-sectional view illustrating an internal configuration of the case binding apparatus 600. The case binding apparatus 600 includes a sheet loading unit A, a gluing unit B, a bonding unit C, a cutting unit D, and a book storage unit E. The sheet loading unit A receives a plurality of sheets discharged from the image forming apparatus 10 and forms a bookblock stack. The gluing unit B applies glue to a bookblock stack received from the sheet loading unit A.

The bonding unit C bonds a cover with the glued bookblock stack. The cutting unit D cuts three sides (except for a side to which the glue is applied) of the bookblock stack together with the bonded cover to adjust the size of the bookblock stack bonded with the cover. The book storage unit E accommodates a plurality of finished booklets. The book storage unit E functions as a booklet storage unit. The sheet loading unit A, the gluing unit B, the bonding unit C, and the cutting unit D cooperatively function as a bookbinding unit.

The case binding apparatus 600 performs a series of bookbinding operations. The sheet loading unit A loads a bookblock stack 640 on a sheet loading tray 620. When a print job includes setting of bookbinding mode, a conveyance roller pair 605 receives sheets discharged from the image forming apparatus 10 and a switching flapper 621 guides the received sheets toward the sheet loading unit A. The sheets are conveyed by conveyance roller pairs 606, 607, 608, and 609 and stacked on the sheet loading tray 620.

The gluing unit B receives the bookblock stack 640 from the sheet loading unit A and performs gluing processing. The gluing unit B includes a gluing gripper 623, a glue container 625, a glue spreading roller 624, and a spreading roller control motor 622. The gluing gripper 623 grips the bookblock stack 640 supplied from the sheet loading unit A. The spreading roller control motor 622 drives the glue spreading roller 624 to apply glue (adhesive) to a lower surface of the bookblock stack 640.

The bonding unit C bonds the gluing-processed bookblock stack 640 with a cover P discharged from the image forming apparatus 10 and conveyed to the bonding unit C by the switching flapper 621. The bonding unit C sends a formed booklet 670 to a trim gripper 612. The trim gripper 612 conveys the booklet 670 to the cutting unit D.

The cutting unit D includes a cutter 628 and a cutter motor 627 that drives the cutter 628. The cutter 628 moves in the horizontal direction to cut the booklet 670 that is conveyed from the bonding unit C by the trim gripper 612. A scrap receiver 633 receives cutting scrap of the booklet 670. When the cutting unit D completes the above-described cutting operation, the cutting scrap collected by the scrap receiver 633 falls into a scrap box 632.

The book storage unit E includes a discharge roller pair 615 that receives the booklet 670 from the cutting unit D. The book storage unit E functions as a stack unit that accommodates the booklet 670. The book storage unit E includes a book supporting plate 630, a loading stabilization plate 634, and a discharge conveyance belt 631. The book supporting plate 630 and the loading stabilization plate 634 hold booklets 670 obliquely. The discharge conveyance belt 631 moves the book supporting plate 630 in the horizontal direction.

The book storage unit E includes a full stack detection sensor 616 and a near-full stack detection sensor 617 that detect the position of the book supporting plate 630 to detect the amount of booklets 670 stored in the book storage unit E. The full stack detection sensor 616 functions as a state detection unit configured to detect a state where the book storage unit E is filled with the booklets 670. The near-full stack detection sensor 617 detects a state where the book storage unit E is almost filled with the booklets 670.

The book storage unit E can be pulled in a direction perpendicular to the front face of the case binding apparatus 600, so that a worker can take the stored booklets 670 out of the book storage unit E. A pull-out detection sensor 635 functions as a state detection unit configured to detect the book storage unit E that is in a pulled-out state.

The above-described processing is a series of bookbinding operations in the bookbinding mode. If the case binding apparatus 600 is not designated as a discharge destination, i.e., when the case binding apparatus 600 does not perform a bookbinding operation, the switching flapper 621 is move in a direction of the conveyance roller pair 610 and guides a sheet to a conveyance path including the conveyance roller pair 610. A sheet guided to the conveyance roller pair 610 by the switching flapper 621 is discharged to a downstream apparatus by conveyance roller pairs 611, 613, 614, and the discharge roller pair 615.

An inserter 650 mounted on the case binding apparatus 600 supplies a cover to be bonded with the bookblock stack 640. The inserter 650 includes a sheet feeding roller 651 that picks a topmost sheet on a sheet feeding tray 654 while the bookblock stack 640 moves into the gluing unit B. Conveyance rollers 652, 653, 603, and 604 convey a sheet (cover Pc). The switching flapper 621 guides the cover Pc to the bonding unit C.

Next, an example sheet conveyance control according to an exemplary embodiment of the present invention, which can be performed by an image forming system including the finisher 500 and the case binding apparatus 600, is described below.

Figure 5:
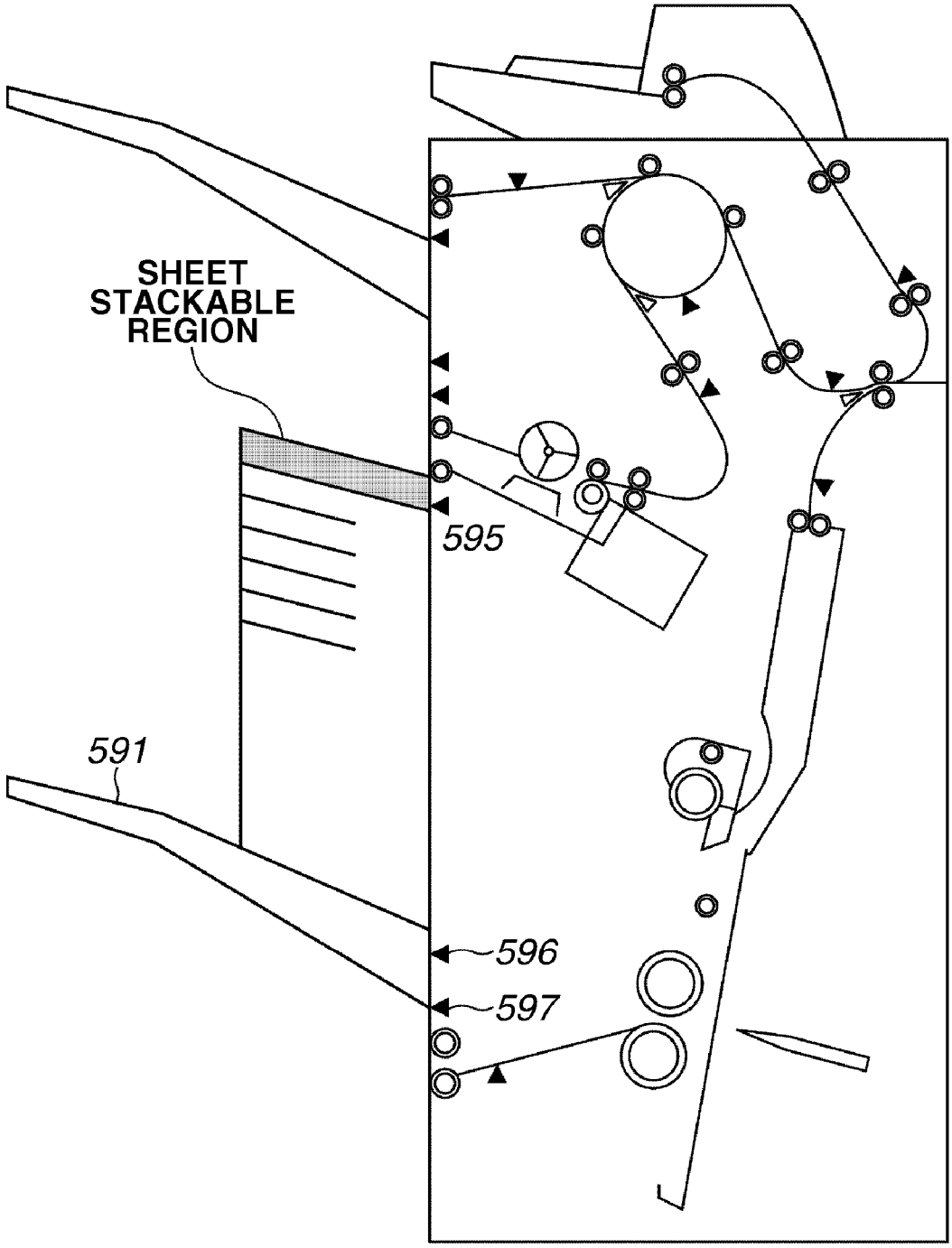
FIG. 5 illustrates an example state of a finisher stopped in response to a full stack alarm.

FIG. 5 illustrates the stack tray 591 of the finisher 500 in a state where the full stack detection sensor 597 detects a full stack alarm state. In FIG. 5, a halftone region indicates a sheet stackable region corresponding to the amount of sheets that the finisher 500 can receive after detection of a full stack alarm state. The sheet stackable region is a region extending from the upper surface position of a bundle of sheets detected by the sheet surface detection sensor 595 to a position corresponding to a sheet discharge port.

If the amount of discharged sheets exceeds the sheet stackable region, newly discharged sheets may collide with the sheets already stacked on the stack tray 591 and causes paper jam. If the number of sheets existing in the conveyance path of the image forming system at the time a full stack alarm state is detected is equal to or less than a predetermined value, namely when the number of sheets existing in the conveyance path of the image forming system is equal to or less than the number of sheets storable in the sheet stackable region, the sheets existing in the conveyance path can be surely discharged.

A sheet conveyance control according to an exemplary embodiment controls the number of sheets fed from a sheet feeding unit so that the number of sheets existing in a conveyance path extending from the sheet feeding unit to a sheet discharge portion of a post-processing apparatus (discharge destination) does not exceed a predetermined number.

More specifically, an exemplary embodiment suppresses the number of sheets existing in the sheet conveyance within the number of receivable sheets (the number of sheets stored in the sheet stackable region).

In general, when sheets are discharged via the processing tray 520 in the finisher 500, the sheet stackable region of the stack tray 591 can deal with an addition of the number of sheets stackable on the processing tray 520 and a set margin. For example, if the number of sheets stackable on the processing tray 520 is 50 sheets and a set margin is 10 sheets, the number of receivable sheets of the stack tray 591 after detection of a full stack alarm state is 60 sheets.

A conveyable sheet amount limiting control according to an exemplary embodiment restricts the number of sheets discharged to the stack tray 591 of the finisher 500 so that the number of sheets existing in the conveyance path extending from a sheet feeding unit to the stack tray 591 (discharge portion of the finisher 500) does not exceed 60 sheets. The conveyable sheet amount limiting control according to an exemplary embodiment can surely discharge the sheets existing in the conveyance path to the sheet discharge portion of the finisher 500 after a full stack alarm state occurs, regardless of the configuration of an image forming system.

The stackable region illustrated in FIG. 5 determines the number of receivable sheets. If the post-processing apparatus has a plurality of discharge portions having different stackable regions, the number of receivable sheets changes.

Furthermore, the number of sheets storable in the stackable region is variable depending on the material or the thickness of sheets. The number of receivable sheets can be changed according to the material of conveyed sheets.

Figure 6:
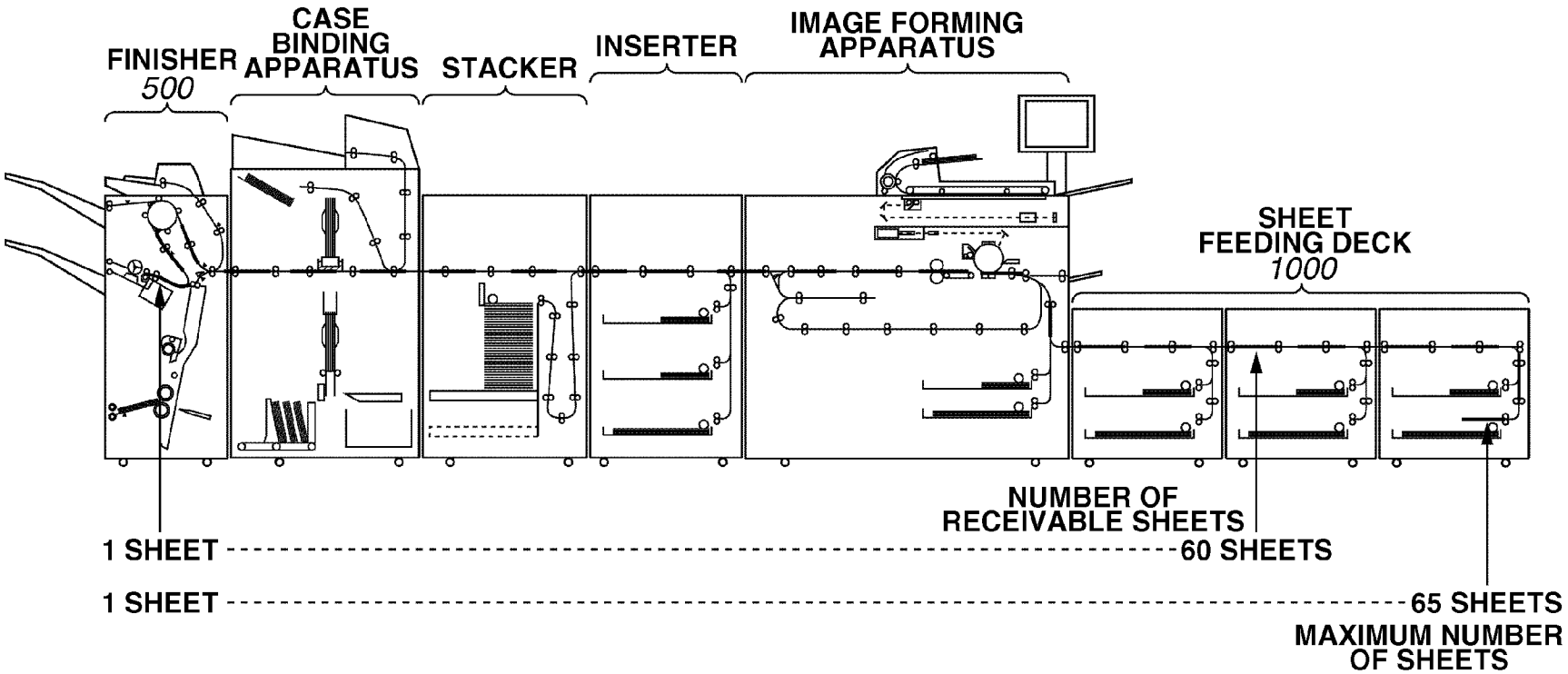
FIG. 6 illustrates an example sheet conveyance state in an image forming system.

FIG. 6 illustrates an example case where the number of receivable sheets is less than the maximum number of sheets. According to an example illustrated in FIG. 6, the number of sheets receivable by the finisher 500 is 60 sheets and the maximum number of sheets that can remain in a conveyance path is 65 sheets when sheets are fed from a sheet feeding unit of the sheet feeding deck 1000 farthest from the image forming apparatus 10.

If the above-described sheet conveyance control is continuously performed during feeding of the 1st to 60th sheets, sheet feeding for the 61st sheet cannot be started until the 1st sheet is discharged to a discharge portion of the finisher 500. More specifically, the interval between the 60th sheet and the 61st sheet becomes larger than the interval between preceding sheets. Accordingly, the number of sheets used for image formation per unit time decreases.

An exemplary embodiment starts processing for limiting the number of conveyable sheets at timing the near-full stack detection sensor 596 detects a full stack near alarm state when sheets are discharged to the stack tray 591 of the finisher 500. More specifically, an exemplary embodiment delays the start timing of the conveyable sheet amount limiting control compared to the ordinary start timing before detection of a full stack near alarm state (e.g., in the feeding of the 1st sheet).

Thus, even when the number of receivable sheets of a discharge destination (post-processing apparatus) is less than the maximum number of sheets that can remain in the conveyance path, an exemplary embodiment can delay the timing for limiting the number of conveyable sheets and, as a result, can minimize reduction in the number of image formation (printed sheets) per unit time.

The CPU circuit unit 900 determines the number of sheets existing in the conveyance path. More specifically, the CPU circuit unit 900 increments a counter value stored in the RAM 903 by one every time a sheet is fed from a feeding unit and decrements the counter value by one when a sheet is discharged to a stack unit. Accordingly, the CPU circuit unit 900 can determine the number of sheets existing in the conveyance path based on the counter value.

Figure 8:
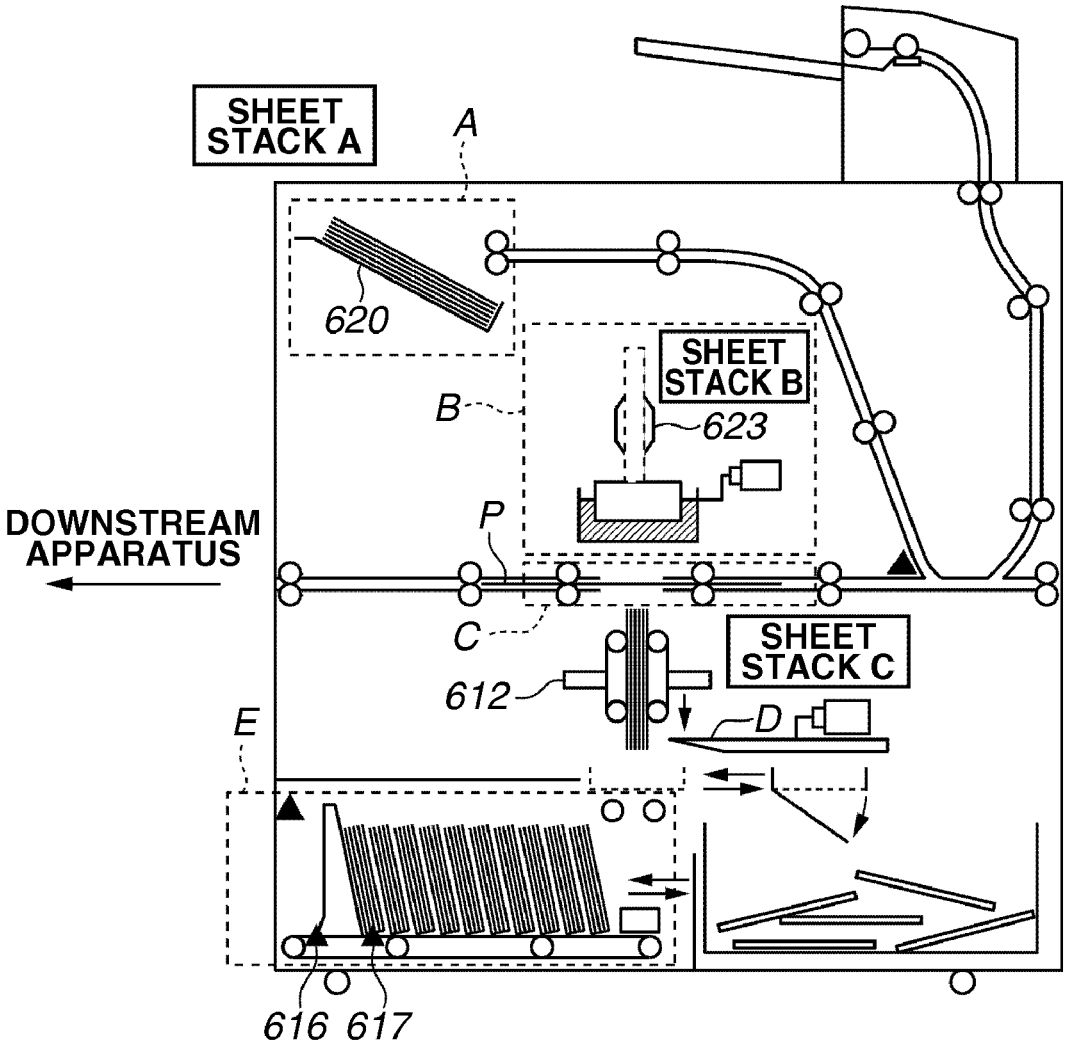
FIG. 8 illustrates an example state of a case binding apparatus stopped in response to a full stack alarm.

FIG. 8 illustrates an example state where the case binding apparatus 600 stops its operation in response to a full stack alarm state detected by the full stack detection sensor 616 provided in the book storage unit E.

After a full stack alarm state is detected, a sheet receivable region of the case binding apparatus 600 is limited to the sheet loading unit A, the gluing unit B, the bonding unit C, and the cutting unit D. The sheet loading unit A can accommodate a bundle of sheets stacked on the sheet loading tray 620. The gluing unit B can accommodate a bundle of sheets held by the gluing gripper 623. The bonding unit C can accommodate a cover P. The cutting unit D can accommodate a bundle of sheets with the cover P held in the trim gripper 612.

As described above, the sheet receivable region in the case binding apparatus 600 is determined in units of a stack. The number of receivable sheets after detection of a full stack alarm state is variable depending on the number of sheets in a bundle, which can be referred to as the number of sheets consisting of a bookblock stack to be bonded with a cover.

Each of the sheet loading tray 620, the gluing gripper 623, and the trim gripper 612 can hold a bundle of sheets (a bookblock stack). Each of the bonding unit C and the trim gripper 612 can accommodate a sheet of cover. Accordingly, the following formula defines the number of receivable sheets. The number of receivable sheets=N (number of sheets consisting of a bookblock stack)×3+2 (number of covers)

An example sheet conveyance control performed when sheets are discharged to the book storage unit E of the case binding apparatus 600 is described below. When the case binding apparatus 600 forms a bookblock stack consists of 10 sheets, the above-described formula derives 32 sheets as the number of receivable sheets. Accordingly, an exemplary embodiment restricts the number of sheets fed from a sheet feeding unit of the image forming system so that the number of sheets existing in the conveyance path (including the sheet loading unit A, the gluing unit B, the bonding unit C, and the cutting unit D) extending from the sheet feeding unit of the image forming system to the book storage unit E is equal to or less than 32.

In other words, an exemplary embodiment restricts the number of sheets fed from a sheet feeding unit of the image forming system so that the number of sheets existing in the sheet conveyance path extending from the sheet feeding unit of the image forming system to the book storage unit E does not exceed 32.

Thus, the case binding apparatus 600 can receive all the sheets existing in the conveyance path of the image forming system after detection of a full stack alarm state.

As described above, a worker can pull the book storage unit E forward to take the finished booklets 670 out of the case binding apparatus 600. When the book storage unit E moves from its home position during a bookbinding operation, the book storage unit E cannot receive the booklet 670 conveyed from the cutting unit D. In other words, the case binding apparatus 600 is brought into an abnormal state according to the present invention. In this case, if the trim gripper 612 of the cutting unit D already holds sheets, the case binding apparatus 600 immediately generates a full stack alarm and notifies the image forming apparatus 10 of the alarm state.

On the other hand, if the trim gripper 612 does not hold any sheet, the case binding apparatus 600 postpones generating a full stack alarm until the trim gripper 612 receives a bundle of sheets from the bonding unit C and notifies the image forming apparatus 10 of the alarm state. The image forming apparatus 10 stops image forming processing in response to the notified full stack alarm, although image formation on the already fed sheets is continuously performed.

The case binding apparatus 600 includes the near-full stack detection sensor 617. However, an alarm state may occur in the case binding apparatus 600 due to a worker's operation during image formation processing before detecting a full stack near alarm state.

Accordingly, the case binding apparatus 600 cannot execute a conveyable sheet amount limiting control similar to that performed for the finisher 500 in response to detection of a full stack near alarm. Accordingly, the case binding apparatus 600 is required to start the conveyable sheet amount limiting control when the image forming apparatus 10 starts image formation processing. More specifically, the case binding apparatus 600 starts the conveyable sheet amount limiting control after completing feeding of sheets corresponding to the number of sheets receivable by a discharge destination (post-processing apparatus).

As described above, the number of receivable sheets of a post-processing apparatus is variable according to sheet conveyance conditions including a tray to which sheets are discharged, material of sheets, and the number of sheets constituting a bundle.

The number of receivable sheets is also variable depending on the arrangement of a post-processing apparatus. Therefore, the number of receivable sheets is changed according to a discharge destination (post-processing apparatus). Furthermore, some types of post-processing apparatuses may be unable to perform a conveyable sheet amount limiting control in response to detection of a full stack near alarm.

Figure 9:
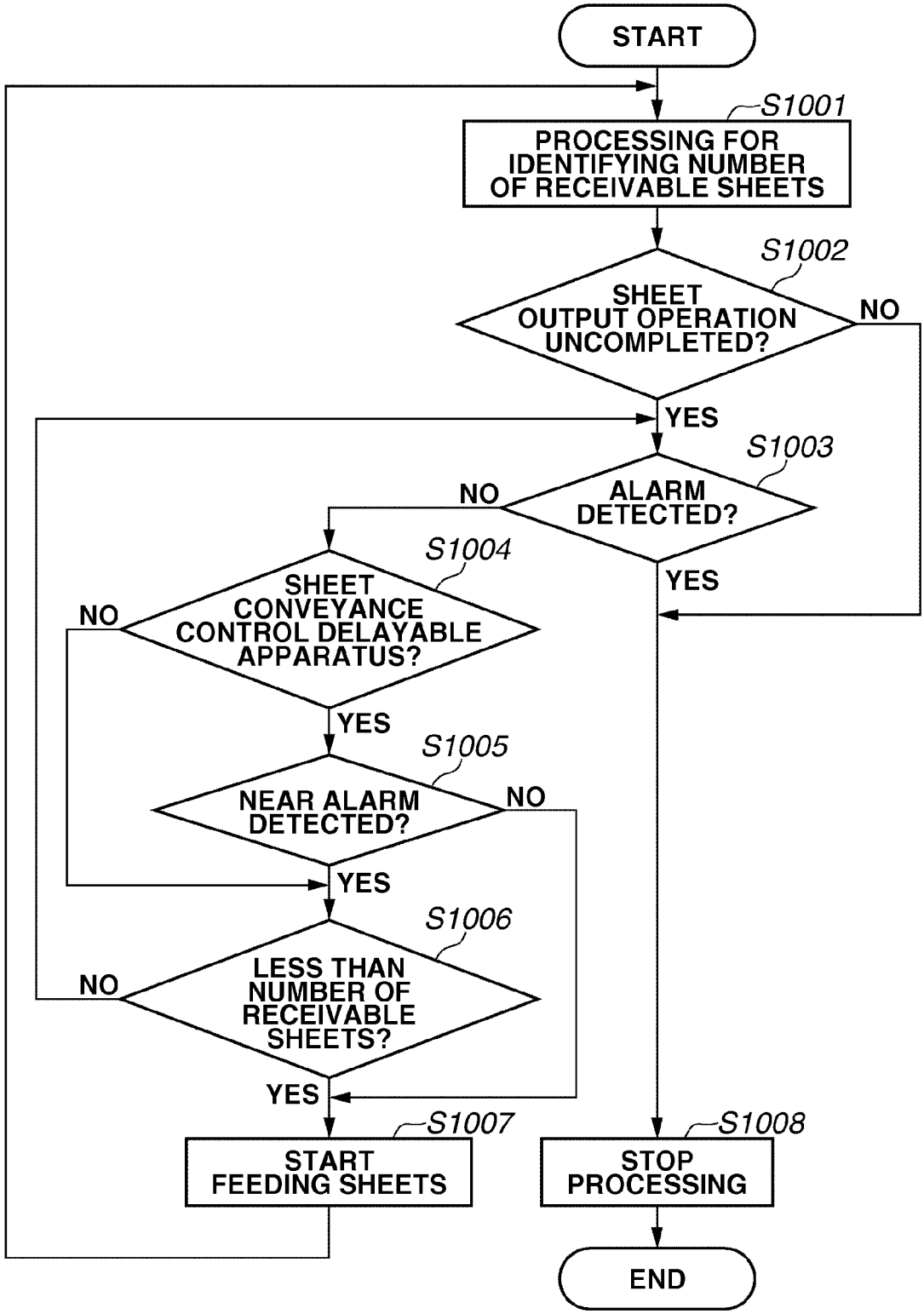
FIG. 9 is a flowchart illustrating an example sheet conveyance control.

Next, an example sheet conveyance control according to an exemplary embodiment of the present invention is described below with reference to a flowchart of FIG. 9. The CPU 901 of the CPU circuit unit 900 executes the processing corresponding to the flowchart illustrated in FIG. 9 based on program(s) stored in the ROM 902.

In step S1001, before starting a sheet feeding operation, the CPU 901 identifies the number of sheets receivable by a discharge destination (post-processing apparatus) based on sheet conveyance conditions relating to the discharge destination (post-processing apparatus). Details of the processing performed in step S1001 is described later.

In step S1002, the CPU 901 determines whether the sheet output operation designated by a print job has completed. If the sheet output operation is uncompleted (YES in step S1002), the processing proceeds to step S1003. If the sheet output operation has been completed (NO in step S1002), the processing proceeds to step S1008. In step S1008, the CPU 901 performs system stop processing.

In step S1003, the CPU 901 communicates with the post-processing apparatus control unit 951 and determines whether any alarm state occurs in the discharge destination (post-processing apparatus). If the CPU 901 determines that any alarm state occurs (YES in step S1003), the processing proceeds to step S1008.

In step S1008, the CPU 901 performs system stop processing. If the CPU 901 determines that no alarm state occurs (NO in step S1003), the processing proceeds to step S1004. In step S1004, the CPU 901 determines whether the discharge destination is a post-processing apparatus that needs not to start the conveyable sheet amount limiting control upon starting the image formation processing.

More specifically, the CPU 901 determines whether the discharge destination is a post-processing apparatus that can start the conveyable sheet amount limiting control when a full stack near alarm state is detected. The CPU 901 executes the determination of step S1004 with reference to information of each post-processing apparatus stored in the ROM 902 or the RAM 903.

If the CPU 901 determines that the discharge destination is a post-processing apparatus that can start the conveyable sheet amount limiting control in response to detection of a full stack near alarm state (YES in step S1004), the processing proceeds to step S1005. If the CPU 901 determines that the discharge destination is a post-processing apparatus that cannot start the conveyable sheet amount limiting control in response to detection of a full stack near alarm state (NO in step S1004), the processing proceeds to step S1006.

In step S1005, the CPU 901 determines whether a full stack near alarm state occurs in the discharge destination (post-processing apparatus). If the CPU 901 determines that no full stack near alarm state occurs (NO in step S1005), the processing proceeds to step S1007. In step S1007, the CPU 901 performs sheet feeding processing. If the CPU 901 determines that a full stack near alarm state occurs (YES in step S1005), the processing proceeds to step S1006. In step S1006, the CPU 901 determines the number of sheets existing in a conveyance path extending from a sheet feeding unit to a sheet discharge portion of the discharge destination (post-processing apparatus).

If the determined number of remaining sheets is less than the number of receivable sheets (YES in step S1006), the processing proceeds to step S1007. In step S1007, the CPU 901 newly starts sheet feeding processing. Then, the processing returns to step S1001. If the determined number of remaining sheets is not less than the number of receivable sheets (NO in step S1006), the CPU 901 skips the sheet feeding processing. The processing returns to step S1003.

Next, receivable sheet amount determination processing according to an exemplary embodiment of the present invention (i.e., details of the processing performed in step S1001) is described below with reference to a flowchart illustrated in FIG. 10.

Figure 10:
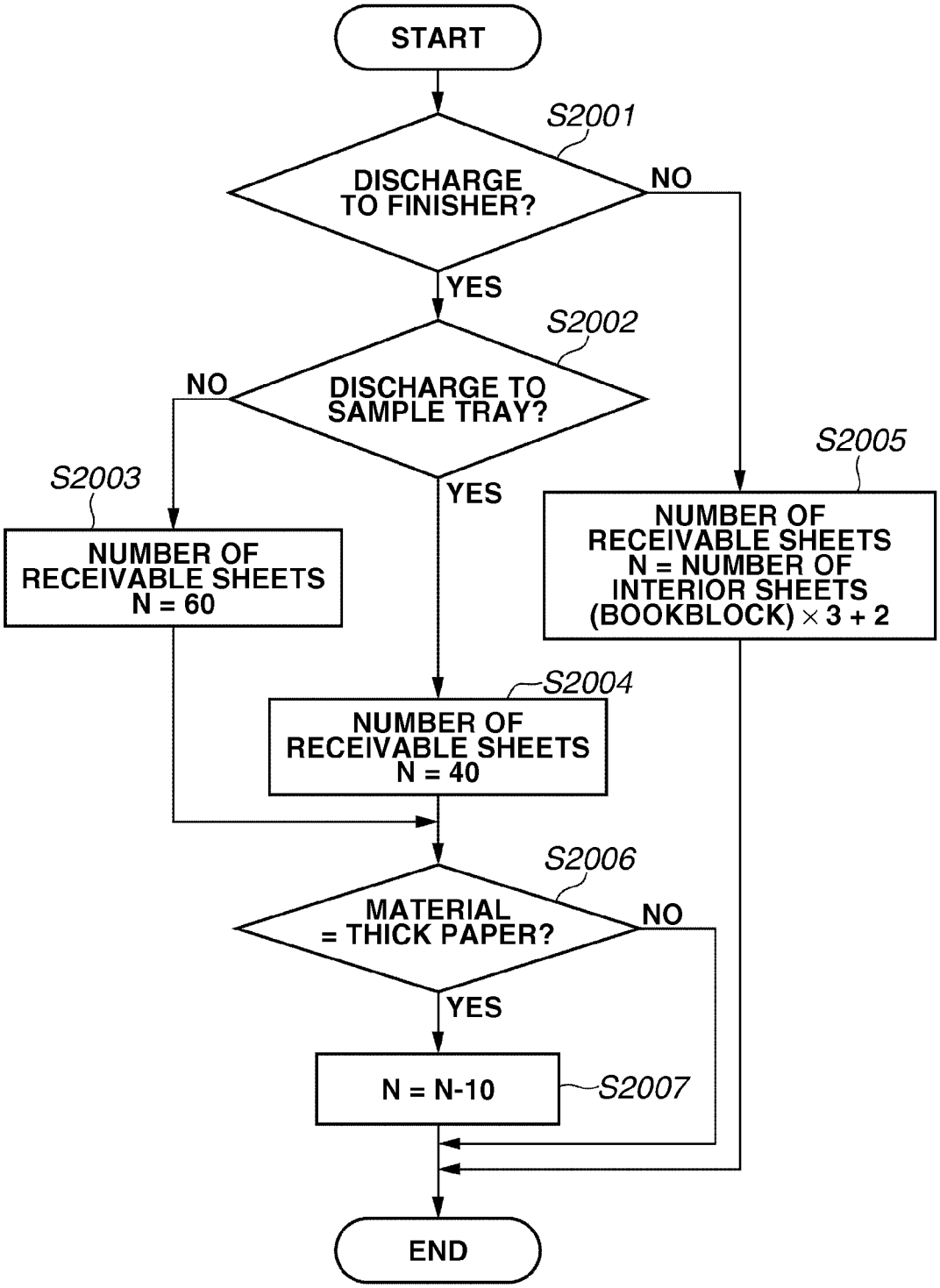
FIG. 10 is a flowchart illustrating example processing for determining the number of receivable sheets.
Figure 11:
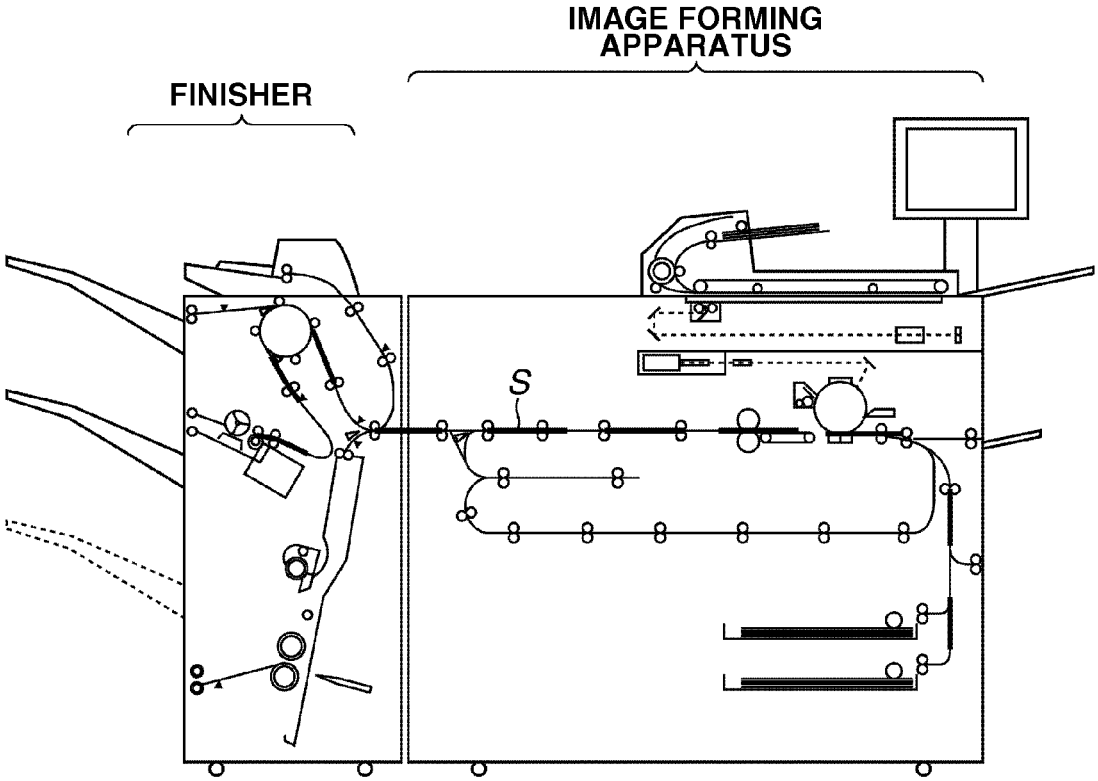
FIG.11 PRIOR ART
FIG. 11 illustrates an example sheet conveyance state in an image forming system.
Figure 12:
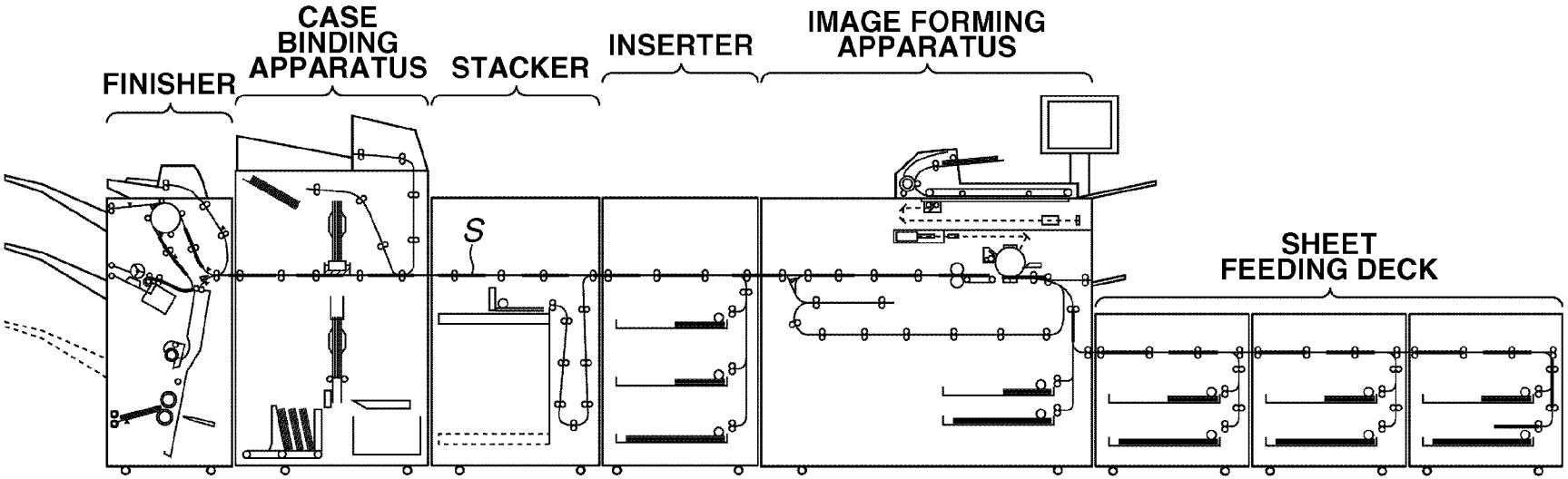
PRIOR ART FIG.12
FIG. 12 illustrates an example sheet conveyance state in an image forming system.

The CPU 901 in the CPU circuit unit 900 executes program(s) stored in the ROM 902 to realize the processing corresponding to the flowchart illustrated in FIG. 10. An example operation performed by the image forming system including the finisher 500 and the case binding apparatus 600 is described below.

In step S2001, the CPU 901 determines whether the finisher 500 is set as a discharge destination. If the CPU 901 determines that the finisher 500 is a discharge destination (YES in step S2001), the processing proceeds to step S2002. If the case binding apparatus 600 is set as a discharge destination (NO in step S2001), the processing proceeds to step S2005.

In step S2002, the CPU 901 determines whether the discharge destination in the finisher 500 is the sample tray 590. If the CPU 901 determines that the discharge destination is the sample tray 590 (YES in step S2002), the processing proceeds to step S2004. If the discharge destination is the stack tray 591 (NO in step S2002), the processing proceeds to step S2003.

In step S2003 (i.e., when the discharge destination is the stack tray 591), the CPU 901 sets the number of receivable sheets (N) to 60 sheets. In step S2004 (i.e., when the discharge destination is the sample tray 590), the CPU 901 sets the number of receivable sheets (N) to 40 sheets.

In step S2005, the CPU 901 calculates the number of sheets constituting a bookblock stack of a booklet to be generated by the case binding apparatus 600 according to the above-described formula. The CPU 901 sets the calculated number of sheets as the number of receivable sheets.

In step S2006, the CPU 901 determines whether the material of sheets discharged to the finisher 500 is set to a thick paper. If the CPU 901 determines that the thick paper is set (YES in step S2006), the processing proceeds to step S2007. In step S2007, the CPU 901 performs processing for correcting the number of stackable sheets considering the thickness of sheets. More specifically, the CPU 901 reduces the number of receivable sheets N by 10 (N=N−10).

Through the above-described processing, the CPU 901 determines the number of receivable sheets for each discharge destination (post-processing apparatus) considering information (e.g., discharge portion, material, and number of sheets constituting a booklet) relating to the post-processing apparatus.

According to the above-described exemplary embodiment, an example alarm state is a fully stacked state of sheets. However, the alarm state according to the present invention includes any other factors by which the system stops operations. If there are two or more alarm states that cause an apparatus to stop operations, the number of receivable sheets is set to a value not smallest.

As described above, regardless of the arrangement of an image forming system, an exemplary embodiment enables a discharge destination (post-processing apparatus) to surely receive all of sheets existing in a conveyance path of the image forming system in response to detection of an alarm state and can minimize reduction in the number of sheets used for image formation per unit time.

In particular, a post-processing apparatus is not required to have a unnecessarily large-scale sheet receiving unit in consideration of a long conveyance path in a large image forming system. The image forming system can be formed at a low cost.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2007-204353 filed Aug. 6, 2007, which is hereby incorporated by reference herein in its entirety.

What is claimed is:

1. An image forming system including an image forming apparatus and a post-processing apparatus that performs post-processing on sheets discharged from the image forming apparatus, the image forming system comprising:

a feeding unit configured to store a plurality of sheets and successively feed the sheets;

an image forming unit configured to form an image on a sheet according to a setting content of an image formation job;

a stack unit configured to stack sheets processed by the post-processing apparatus;

a state detection unit configured to detect a predetermined state of the stack unit, the predetermined state being a state in which the stack unit cannot receive any sheet;

a control unit configured to determine, based on the setting content of an image formation job, a number of sheets that the post-processing apparatus can receive from the image forming apparatus after detection of the predetermined state; and a sheet number detecting unit configured to detect a number of sheets existing in a sheet conveyance path extending from the feeding unit to the stack unit;

wherein the control unit is operable to restrict a number of sheets fed from the feeding unit so that the number of sheets detected by the sheet number detecting unit does not exceed the determined number of sheets.

2. An image forming system including an image forming apparatus and a post-processing apparatus that performs post-processing on sheets discharged from the image forming apparatus, the image forming system comprising:

a feeding unit configured to store a plurality of sheets and successively feed the sheets;

an image forming unit configured to form an image on a sheet according to a setting content of an image formation job;

a stack unit configured to stack sheets processed by the post-processing apparatus;

a state detection unit configured to detect a predetermined state of the stack unit, the predetermined state being a state in which a predetermined number of sheets are stacked;

a control unit configure to determine a number of sheets that the post-processing apparatus can receive from the image forming apparatus after detection of the predetermined state; and a sheet number detecting unit configured to detect a number of sheets existing in a sheet conveyance path extending from the feeding unit to the stack unit;

wherein the control unit is operable to restrict a number of sheets fed from the feeding unit so that the number of sheets detected by the sheet number detecting unit does not exceed the determined number of sheets.

3. The image forming system according to claim 1, wherein the control unit is operable, when the number of sheet detected by the sheet number detecting unit reaches the determined number of sheets, to inhibit feeding from the feeding the next sheet unless a sheet is discharged from the sheet conveyance path to the stack unit.

4. The image forming system according to claim 1, wherein the state detection unit is operable to determine whether the amount of sheets stackable by the stack unit becomes a predetermined amount.

5. The image forming system according to claim 1, wherein the state detection unit is operable to determine whether the stack unit is incapable of stacking any sheet.

6. The image forming system according to claim 1, further comprising alarm state detection unit configured to detect an alarm state of the stack unit that is a state preceding the predetermined state, wherein the control unit is operable, when the alarm state detection unit detects the alarm state, to restrict a number of sheets fed from the feeding unit.

7. The image forming system according to claim 6, wherein the state detection unit is operable to determine whether an amount of sheets stackable by the stack unit becomes a first predetermined amount, and the alarm state detection unit is operable to determine whether an amount of sheets stackable by the stack unit becomes a second predetermined amount that is larger than the first predetermined amount.

8. An image forming system comprising:

a feeding unit configured to store sheets and successively feed the sheets;

an image forming unit configured to form an image on a sheet fed by the feeding unit based on a setting content of an image formation job;

a bookbinding unit configured to bind a plurality of sheets processed by the image forming unit into a booklet;

a booklet storage unit configured to accommodate a plurality of booklets formed by the bookbinding unit;

a state detection unit configured to detect a predetermined state of the booklet storage unit in which the booklet storage unit cannot accommodate any booklet;

a control unit configured to determine, based on the setting content of the image formation job, a number of sheets that the bookbinding unit can receive after detection of the predetermined state; and a sheet number detecting unit configured to detect a number of sheets existing in a sheet conveyance path extending from the feeding unit to the stack unit;

wherein the control unit is operable to restrict a number of sheets fed from the feeding unit so that the number of sheets detected by the sheet number detecting unit does not exceed the determined number of sheets.

9. The image forming system according to claim 8, wherein the control unit is operable to determine the number of sheets that the bookbinding unit can receive according to a number of sheets constituting the booklet.

10. An image forming system comprising:

a feeding unit configured to store sheets and successively feed the sheets;

an image forming unit configured to form an image on a sheet fed by the feeding unit based on a setting content of an image formation job;

a stack unit configured to stack a plurality of sheets processed by the image forming unit;

a detection unit configured to detect a fully stacked condition of sheets stacked by the stack unit;

a control unit configured to determine a number of sheets that the stack unit can receive after detection of the fully stacked condition; and a sheet number detecting unit configured to detect a number of sheets existing in a sheet conveyance path extending from the feeding unit to the stack unit;

wherein the control unit is operable to restrict the number of sheets fed from the feeding unit so that the number of sheet detected by the sheet number detecting unit does not exceed the determined number of sheets.

11. The image forming system according to claim 10, further comprising alarm state detection unit configured to detect an alarm state of the stack unit preceding the fully stacked condition, wherein the control unit is operable, when the alarm state detection unit detects the alarm state, to restrict an amount of sheets fed from the feeding unit so that the number of sheets existing in the sheet conveyance path does not exceed a predetermined number of sheets.

12. An image forming apparatus configured to be connected, when in use, to a post-processing apparatus that includes a stack unit configured to stack sheets processed by the image forming apparatus, the image forming apparatus comprising:

a feeding unit configured to store sheets and successively feed the sheets;

an image forming unit configured to form an image on a sheet based on a setting content of an image formation job;

a state detection unit configured to detect a predetermined state of the stack unit, the predetermined state being a state in which the stack unit cannot receive any sheet, based on communication with the connected post-processing apparatus; and a control unit configured to determine, based on the setting content of the image formation job, a number of sheets that the post-processing apparatus can receive after detection of the predetermined state of the stack unit; and a sheet number detecting unit configured to detect a number of sheets existing in a sheet conveyance path extending from the feeding unit to the stack unit;

wherein the control unit is operable to restrict number of sheets fed from the feeding unit so that the number of sheets detected by the sheet number detecting unit does not exceed the determined number of sheets.

13. An image forming apparatus configure to be connected, when in use, to a post-processing apparatus that includes a stack unit configured to stack sheets processed by the image forming apparatus, the image forming apparatus comprising:

a feeding unit configured to store and successively feed the sheets;

an image forming unit configured to form an image on a sheet based on a setting content of an image formation job;

a state detection unit configured to detect a predetermined state of the stack unit, the predetermined state being a state in which a predetermined number of sheets are stacked, based on communication with the connected post-processing apparatus;

a control unit configured to determine a number of sheets that the post-processing apparatus can receive after detection of the predetermined state of the stack unit; and a sheet number detecting unit configured to detect a number of sheets existing in a sheet conveyance path extending from the feeding unit to the stack unit;

wherein the control unit is operable to restrict number of sheets fed from the feeding unit so that the number of sheets detected by the sheet number detecting unit does not exceed the determined number of sheets.

* * * * *